United States Patent [19]

Cotutsca

[11] Patent Number: 4,901,456

[45] Date of Patent: Feb. 20, 1990

[54] MAGNETICALLY SUPPORTED DISPLAY

[76] Inventor: Peter Cotutsca, 23127 Meyler Ave., Torrance, Calif. 90502

[21] Appl. No.: 273,807

[22] Filed: Nov. 21, 1988

[51] Int. Cl.[4] ..... G09F 1/12

[52] U.S. Cl. ..... 40/152.1; 272/8 D; 40/617; 40/427; 40/538

[58] Field of Search ..... 40/152.1, 152, 426, 40/214; 272/8 R, 8 N, 8 D

[56] References Cited

U.S. PATENT DOCUMENTS

| | | | |
|---|---|---|---|
| 2,220,049 | 10/1940 | Dunmore | 40/426 |
| 2,383,390 | 8/1945 | Jacobs | 40/214 |
| 2,557,383 | 6/1951 | Kerwer | 40/214 |
| 2,702,191 | 2/1955 | Lemelson | 40/426 |
| 3,139,865 | 7/1964 | Aimes | 40/427 |
| 3,196,566 | 7/1965 | Littlefield | 40/538 |
| 3,561,146 | 2/1971 | Dembar | 40/152 |
| 3,576,374 | 4/1971 | Lile | 272/8 N |
| 3,609,606 | 9/1971 | Podesto | 335/209 |
| 3,716,936 | 2/1973 | Miller | 40/152 |
| 3,874,102 | 4/1975 | Sheppard | 40/426 |
| 3,955,315 | 5/1976 | Goodman | 46/238 |
| 4,178,707 | 12/1979 | Littlefield | 40/538 |
| 4,414,775 | 11/1983 | Jensen | 46/241 |
| 4,568,301 | 2/1986 | Hawley, Jr. | 446/134 |
| 4,837,955 | 6/1989 | Grabhorn | 40/214 |

FOREIGN PATENT DOCUMENTS

| | | | |
|---|---|---|---|
| 497087 | 11/1919 | France | 40/617 |
| 445765 | 2/1949 | Italy | 40/214 |

OTHER PUBLICATIONS

Popular Science, Apr. 1988, p. 94, illustrates magnetic attraction suspending a globe, with a position sensor below the sphere regulating power to the overhanding electromagnet.

*Primary Examiner*—Kenneth J. Dorner
*Assistant Examiner*—Wenceslao J. Contreras
*Attorney, Agent, or Firm*—Sheldon & Mak

[57] ABSTRACT

A display device is disclosed herein having a base defining a display area between the opposite surfaces of a pair of plates in which a member is magnetically supported on a filament extending between one plate and the member which a magnetic is mounted on the other plate. Magnetic material or a second magnetic is carried on the member in attractive relationship to the first magnetic so that the member is magnetically suspended in the display area pulling taut against the filament. Articles to be displayed such as photos or the like are mounted for visual observation on the member.

25 Claims, 1 Drawing Sheet

MAGNETICALLY SUPPORTED DISPLAY

BACKGROUND OF THE INVENTION

1. Field of the Invention

The present invention relates to display devices and more particularly to a novel means for displaying an object so as to appear in a suspended or floating position.

2. Brief Description of the Prior Art

It has been the conventional practice to display articles such as photographs or the like in frames that are two-dimensional and that are supported by pivot means to bases or mounts so that the holder appears to be static or rigidly positioned. In such devices, a rigid frame, including glass, serves to hold a photograph, as an example, and the frame is either supported from the rear by a leg or stanchion, or the sides of the frame are connected to a base that supports the frame in a fixed position.

Although such prior frame holders and photo holders have been useful for their intended purpose, the ornamental or decorative appearance and presentation of the photographic material is unimaginative and rigid. Also, such prior frames or holders are adapted to support a single photograph or perhaps a multiple of photographs but in the same plane. That is to say, multiple photographs can be shown on a flat surface when viewed from a single direction.

Therefore, a long standing need has existed to provide a novel means for presenting an article to be displayed so that the viewer's imagination is stimulated and so that multiple objects can be displayed simultaneously in different planes of view. Such a means controllably supports the objects in a floating or suspended position which creates an interesting and stimulating environment for portrayal of the objects being displayed.

SUMMARY OF THE INVENTION

Accordingly, the above problems and difficulties are obviated by the present invention which provides a novel display means comprising a base means having end plates with a display area defined between the opposing surfaces of the plates. The uppermost plate mounts a fixed magnet and a second magnet or magnetic material is placed on a display holder positionable within the display area. A filament couples the other plate to the underside of the holder and a magnetic coupling occurs between the pair of magnets and magnetic material so that attraction occurs for suspending the holder immediately under the plate in spaced relationship thereto so that the filament is drawn taut, giving the holder a floating or suspended visual impression.

The holder is characterized as having means for supporting a single or a plurality of articles such as photographs intended to e displayed within the area defined.

Therefore, it is among the primary objects of the present invention to provide a novel display means having a display area magnetically supporting a display holder for enclosing articles to be visually presented and viewed.

Another object of the present invention is to provide a novel holder for displaying a variety of articles so that the display appears to be in a floating or suspended position within a display area defined on a base mounting means.

Still another object of the present invention is to provide a novel display for magnetically supporting a holder for articles so that the articles appear to be floating or suspended within a display area between mounting plates.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

DESCRIPTION OF THE PREFERRED EMBODIMENT

Figure 1:
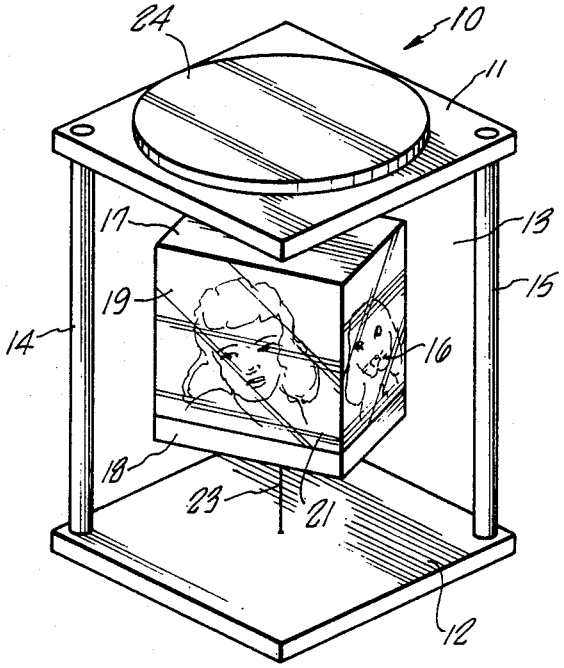
FIG. 1 is a front perspective view showing the novel display apparatus of the present invention magnetically suspending an article to be displayed.

Referring to FIG. 1, the novel display of the present invention is shown in the general direction of arrow 10 which includes an upper plate 11 and a lower plate 12 defining a display area between their opposite and opposing surfaces wherein the display area is generally represented by the numeral 13. The plates 11 and 12 are joined together by suitable means, such as posts 14 and 15, which are arranged to interconnect edge marginal regions of the respective plates. It is understood that a single mounting member can interconnect the plates along common edges in place of the posts, if desired.

Suspended within the display area 13, there is provided a holder 16 which is composed of transparent material so that an article to be displayed can be visually viewed through the holder composition. In the present illustration, the holder 16 comprises a cube which is indicated by numeral 17 into which a foam block is carried on a retainer 18. The foam block is illustrated in general by the numeral 19. In the present illustration, the article to be displayed is a photograph, such as indicated by numeral 21, behind the wall of the cube holder 17. Therefore, the photograph which is flat is positioned between the outer surface of one side of block 19 and the inner surface of the wall comprising the cube 17. The retainer 18 not only holds the block in position but holds the photo or photograph in position around the cube.

A filament 23 is connected at one end to the plate 12 and at its other end to the underside of the retainer 18. Magnetic means are carried between the upper plate 11 and cooperates with magnetic means carried on the holder 17 so that a magnetic coupling occurs in attraction so that the holder is drawn upwardly toward the top plate 11. Resistance to the attractive force is experienced when the holder draws filament 23 taut. Therefore, the resultant effect is that the holder 17 is in a suspended appearing condition and appears to float within the display area 13. A cover 24 is employed on the top plate 11 which covers the magnetic means on the plate.

Figure 2:
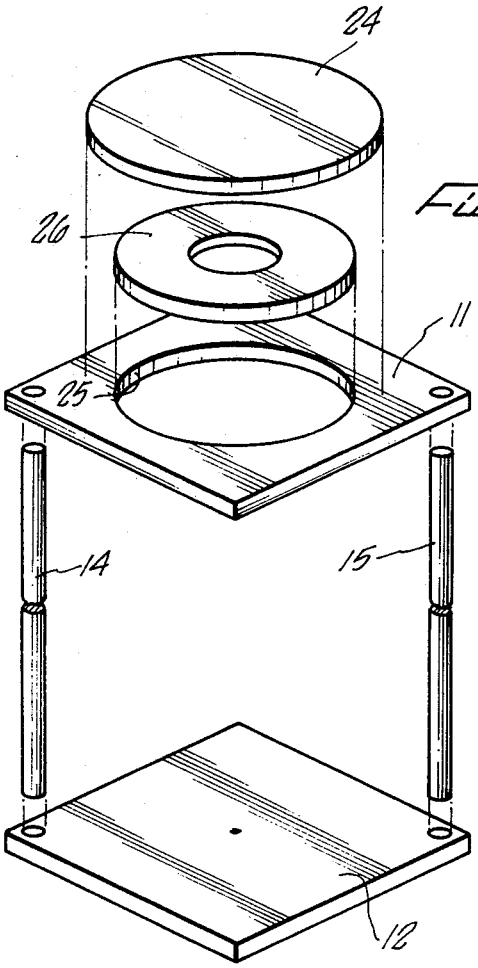
FIG. 2 is a front exploded perspective view showing the mounting means for suspending the holder enclosing the article to be presented.

Referring now in detail to FIG. 2, the base or mount for defining the display area is illustrated and it can be seen that the plates 11 and 12 are arranged in fixed spaced-apart relationship by the mounting posts 14 and 15 respectively. Also, the upper plate 11 includes a circular cutout 25 for insertably receiving a ring magnet 26 therein. Once so positioned, the cover 24 is placed against the upper exposed surface of the plate 11 so that the magnet 26 is covered and out of view. Preferably, the ring magnet 26 is composed of a ceramic material.

Figure 3:
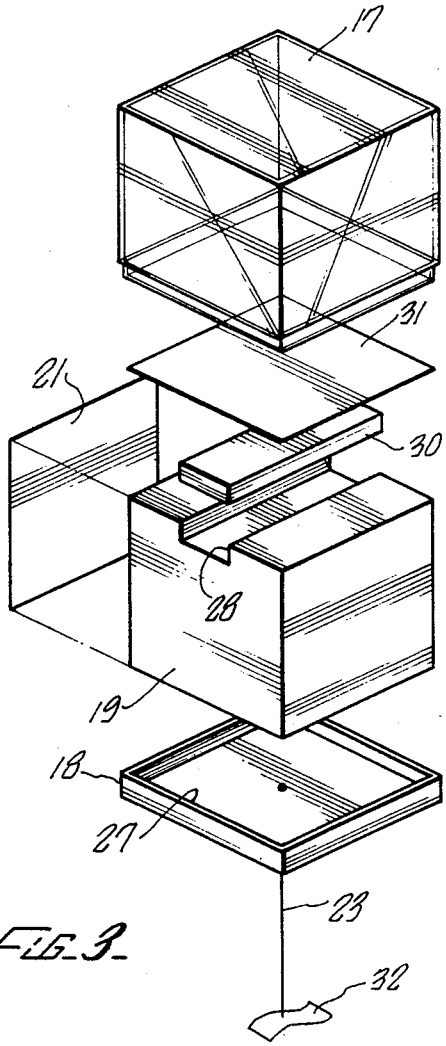
FIG. 3 is an exploded perspective view showing the holder for the article or articles to be displayed in a floating or suspended position.

Referring now in detail to FIG. 3, the holder for the object to be displayed is illustrated in exploded form whereas it can be seen that the cube 17 is of a transparent plastic material so as to be light in weight, and further includes a snap-lock portion 26 on its lower side adapted to mate with a groove 27 within the retainer 18. The block 19 is composed of a lightweight cellular foam material and includes a slot or groove 28 for holding ferro-magnetic material or a second magnet, which is identified by numeral 30. A covering sheet 31 is placed over the top of the block and the ferromagnetic material or the second magnet. The photograph is illustrated by numeral 21 which is disposed against the surface of the block 19 so as to bear against the inside of a transparent wall of the holder or housing 17. The retainer 18 holds the assembly of the block, magnet or ferro-magnetic material, cover sheet and the transparent case or housing 17 together in an integral unit and includes the articles to be displayed as well. A tape 32 secures an end of the filament 23 to the underside of base 12 at one end and a similar tape or other adhesive or connection means couples the opposite end of the filament to the underside of the retainer 18. Therefore, the object to be displayed within the holder 17 is anchored to the plate 12.

When fully assembled, the operating principle of the invention is based on the laws of magnetism. The first magnet mounted above the object or holder is attracted to the second magnet or ferro-magnetic material. Using the attraction of opposite magnetic poles, the object or holder 17 can be made to appear weightless. With the string or filament 23 adjusted so that the object or holder stays within the magnetic field, the objects to be displayed will be within the display area for viewing. However, the object or holder will be floating in the air to give the appearance of an anti-gravity effect. The actual distance between the mounted magnet in the top plate 11 and the floating or suspended holder varies depending on the grade of magnets, weight of the holder or objects and the material used.

It is also to be understood that the magnetic principle can be employed when utilizing a flat picture frame. In this instance, a pair of filaments is used at opposite ends of the flat frame and the second magnet or ferro-magnetic material is placed at the top of the frame immediately under the top supporting plate 11 so that magnetic attraction occurs between the magnets or magnetic material. Therefore, different anchoring means may be provided by employing a single filament, a double filament in spaced relationship, or multiple filaments, depending on the size, shape and weight of the article being displayed. Also, it is to be understood that the article to be displayed may be either a magnet or of ferro-magnetic material and as such, the underside of the article will be anchored by a string or filament to the bottom plate. In such an instance, the article becomes the holder in accordance with the principles of the present invention.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A display device comprising:

a base having an open display area;

an at least partly transparent display holder disposed in said display area in spaced relationship to said base the holder being formed to removably receive within the at least partly transparent display holder an article for display;

means carried on said base for supporting said at least partly transparent display holder having a flexible anchor securing said at least partly transparent display holder to said base and first magnetic means carried on said base and cooperating with a second magnetic means of at least partly transparent display holder whereby magnetic forces hold said at least partly transparent display holder within said display area against said anchor, said holder including a transparent cube surrounding a block and said article to be displayed being disposed between said block and said cube, wherein said article to be displayed is a photograph, said base including a pair of plates held apart by supports and the opposing surfaces of said plates defining said display area, said magnetic means including a first magnetic means fixed on an upper one of said plates and a second magnetic or ferro-magnetic material carried on said holder in a groove in the block in close proximity to said base plate carrying said first magnetic means.

2. The display device as claimed in claim 1 wherein:

said anchor is a string secured at its opposite ends to said base plate and said holder respectively.

3. The display device as claimed in claim 2 wherein:

said holder includes a retaining means for releasably holding said cube, said block and said photograph together as a unitary construction.

4. The display device as claimed in claim 2 wherein:

said holder includes a retaining means for releasably holding said cube, said block and said photograph operatively together as a unitary construction, said retaining means receiving the anchor.

5. A display device comprising:

a base having an open display area;

a display holder with a transparent wall disposed in said display area in spaced relationship to said base, the holder being formed to removably receive behind the transparent wall a picture for display;

means carried on said base for supporting said display holder having a flexible anchor filament securing said display holder to said base and first magnetic means carried on said base and cooperating with a second magnetic means of said holder whereby magnetic attraction forces hold said display holder within said display area against said anchor; and the display holder including a block, the block having means supporting the second magnetic means.

6. A display device as claimed in claim 5 wherein the filament is substantially transparent.

7. A display device as claimed in claim 5 wherein the filament secures the display holder whereby the holder appears to float within the display area.

8. A display device comprising the combination of:

a base having an open display area;

a display holder with a transparent wall disposed in said display area in spaced relationship to said base, the holder being formed to removably receive behind the transparent wall a picture for display;

means carried on said base for supporting said display holder having a flexible anchor securing said display holder to said base and first magnetic means carried on said base and cooperating with a second magnetic means of said display holder whereby magnetic forces hold said display holder within said display area against said anchor such that in operative relationship the anchor remains taut and vertically aligned; and the display holder being a structure, and including a block in the structure, and a formation in the block receiving the second magnet.

9. A display device as claimed in claim 8 wherein the filament is substantially transparent.

10. A display device as claimed in claim 8 wherein the filament secures the display holder whereby the holder appears to float within the display area.

11. A display device as claimed in claim 8 including transparent planar walls in different planes for receive pictures behind the different walls.

12. A display device comprising:

a base having an open display area;

an at least partly transparent display holder disposed in said display area in spaced relationship to said base, the holder being formed to removably receive a picture for display within the transparent holder;

means carried on said base for supporting said display holder having a flexible anchor securing said display holder to said base and first permanent magnetic means carried on said base and cooperating with a second permanent magnetic means of said holder whereby magnetic forces float said display holder within said display area against said flexible anchor; and the display holder being a structure, and including a block in the structure, and a formation in the block receiving the second magnet.

13. A display device as claimed in claim 12 wherein the filament is substantially transparent.

14. A display device as claimed in claim 12 wherein the filament secures the display holder whereby the holder appears to float within the display area.

15. A display device as claimed in claim 12 wherein the display holder is a structure, and including a foam block in the structure, and a formation in the block to receive the second magnet.

16. A display device as claimed in claim 12 wherein the display holder is rigid and is normally intended for firm location on a support, and wherein the magnetic forces float the holder in suspension.

17. A display device comprising the combination of:

a base having an open display area including a bottom plate, spaced posts and a top plate, the spaced posts being fixed between the bottom plate and top plate so that the open display area is formed between the plates and posts;

an at least partly transparent display holder disposed in said display area in spaced relationship to said base and the at least partly transparent holder being formed to removably receive a picture for display;

means carried on said base for supporting said display holder having a flexible anchor securing said display holder to the bottom plate of said base and first permanent magnetic means carried on the top plate of said base and cooperating with a second permanent magnetic means of said display holder whereby magnetic attraction forces float said display holder within said display area against said anchor such that in operative relationship the anchor remains taut and vertically aligned; and the display holder being a structure, and including a block in the structure, and a formation in the block for receiving the second magnet.

18. A display device as claimed in claim 17 wherein the filament is substantially transparent.

19. A display device as claimed in claim 17 wherein the filament secures the display holder whereby the holder appears to float within the display area.

20. A display device as claimed in claim 17 wherein the display holder includes transparent planar walls in different planes for receiving pictures behind the different walls.

21. A display device comprising the combination of:

a base having an open display area including a bottom plate, a pair of spaced posts and a top plate, the spaced posts being fixed between the bottom plate and top plate so that the opened display area is formed between the plates and posts;

a display holder being a cube with transparent walls disposed in said display area in spaced relationship to said base the cube being formed to removably receive selectively pictures behind the transparent walls for display;

means carried on said base for supporting said display holder having a flexible anchor securing said display holder to the bottom plate of said base and first permanent magnetic means carried on the top plate of said base and cooperating with a second permanent magnetic means of said display holder whereby magnetic forces float said display holder within said display area against said anchor such that in operative relationship the anchor remains taut and vertically aligned; and the display holder being a structure, and including a block in the structure, and a formation in the block for receiving the second magnet.

22. A display device as claimed in claim 21 wherein the filament is substantially transparent.

23. A display device as claimed in claim 21 wherein the filament secures the display holder whereby the holder appears to float within the display area.

24. A display device comprising the combination of:

a base having an open display area including a bottom plate, post means and a top plate, the post means being fixed between the bottom plate and top plate so that the open display area is formed between the plates and the posts means;

a display holder being a rigid structure with transparent walls in different planes disposed in said display area in spaced relationship to said base, the holder being formed to removably receive selectively multiple pictures for display behind the transparent walls for display;

means carried on said base for supporting said display holder having a flexible anchor securing one end of said display holder to the bottom plate of said base and first permanent magnetic means carried on the top plate of said base and cooperating with a second permanent magnetic means of said display holder whereby magnetic forces float said display holder in a suspended position within said display area against said anchor such that in operative relationship the anchor remains taut and vertically aligned; and a block in the structure receiving the second magnet.

25. A display device as claimed in claim 24 wherein the filament is substantially transparent.

* * * * *